US007137871B2

(12) United States Patent
Gottschald et al.

(10) Patent No.: US 7,137,871 B2
(45) Date of Patent: Nov. 21, 2006

(54) SPECTACLE LENS EDGING MACHINE

(75) Inventors: Lutz Gottschald, Meerbusch (DE); Fritz Kotting, Dormagen (DE); Joerg Luderich, Ratingen (DE)

(73) Assignee: Wernicke & Co. GmbH (DE)

( * ) Notice: Subject to any disclaimer, the term of this patent is extended or adjusted under 35 U.S.C. 154(b) by 137 days.

(21) Appl. No.: 11/020,533

(22) Filed: Dec. 23, 2004

(65) Prior Publication Data

US 2005/0107002 A1 May 19, 2005

Related U.S. Application Data

(63) Continuation of application No. 09/762,117, filed as application No. PCT/EP99/04444 on Jun. 26, 1999.

(30) Foreign Application Priority Data

Aug. 1, 1998 (DE) ..... 198 34 748

(51) Int. Cl.
*B24B 7/00* (2006.01)
*B24B 51/00* (2006.01)

(52) U.S. Cl. ..... 451/11; 451/66; 451/255

(58) Field of Classification Search ..... 451/11, 451/66, 255, 256, 42–44, 277, 325
See application file for complete search history.

(56) References Cited

U.S. PATENT DOCUMENTS 5,363,597 A 11/1994 Gottschald et al.
5,882,247 A 3/1999 Longuet et al.
6,019,669 A * 2/2000 Kitao et al. ..... 451/43
6,045,432 A 4/2000 Shibata
6,672,944 B1 * 1/2004 Eto et al. ..... 451/43

FOREIGN PATENT DOCUMENTS

| | | |
|---|---|---|
| DE | 31 05 100 | 8/1982 |
| DE | 87 06 215 | 9/1988 |
| DE | 43 08 800 | 10/1993 |
| DE | 196 16 572 | 2/1997 |
| EP | 0 820 837 | 1/1998 |
| EP | 0 838 306 | 4/1998 |
| WO | 98 09770 | 3/1998 |

* cited by examiner

*Primary Examiner*—Hadi Shakeri
(74) *Attorney, Agent, or Firm*—Ostrolenk, Faber, Gerb & Soffen, LLP

(57) ABSTRACT

The invention relates to a grinding machine for the edges of spectacles lenses, comprising at least one grindstone and one driven shaft for holding the spectacles lenses, said shaft being able to move radially and axially relatively to the grindstone. The inventive grinding machine comprises at least one operational support which is placed in such a way that it can rotate coaxially on a spindle designed for a shaft of the grinding machine or on at least one pivoting lever which is placed in a non-aligned position on a spindle designed for a shaft of the grinding machine, said operational support being free to pivot in the space between the grindstone and the shaft holding the spectacles glasses.

20 Claims, 4 Drawing Sheets

SPECTACLE LENS EDGING MACHINE

CROSS-REFERENCE TO RELATED APPLICATION

This is a continuation of U.S. patent application Ser. No. 09/762,117, filed Aug. 9, 2001 in the name of Lutz Gottschald et al. entitled SPECTACLE-LENS EDGING MACHINE.

BACKGROUND OF THE INVENTION

The invention relates to a spectacle-lens edging machine having at least one grinding wheel and a rotatable spectacle-lens retaining shaft radially and axially adjustable relative to the grinding wheel. Function carriers may be integrated in such spectacle-lens edging machines in order to carry out additional functions, for example measuring functions or additional machining steps, in addition to the edging.

Described in U.S. Pat. No. 5,363,597 of the same applicant, issued Nov. 15, 1994 for example, is a spectacle-lens edging machine having two coaxial half shafts for retaining and rotating a spectacle lens, a grinding spindle arranged in an axially parallel manner relative to the half shafts and movable radially and axially with its bearing housing relative to the latter and having a rough-grinding wheel and a finish-grinding wheel for grinding the spectacle-lens periphery, and if need be having a groove for grinding a top facet, and a form-turning tool arranged on the bearing housing and following its radial and axial movements relative to the half shafts with the spectacle lens, or a cutting tool which rotates about an axis running radially relative to the spectacle lens and is intended for producing a groove or channel in the spectacle-lens periphery and/or for beveling the edges of the spectacle-lens periphery. In this known spectacle-lens edging machine, the cutting tool is arranged next to the grinding wheel, so that the spectacle lens to be machined has to be moved axially and radially into the region of this cutting tool. U.S. Pat. No. 5,363,597 is hereby incorporated by reference as if fully set forth herein.

Furthermore, described in DE 196 16 572 C2 of the same applicant is an arrangement for measuring a facet groove in a spectacle-lens opening of a spectacle frame, or a predetermined spectacle lens having a non-circular shape, or a form wheel in a spectacle-lens edging machine having at least one grinding wheel, a rotatable spectacle-lens retaining shaft radially and axially adjustable relative to the grinding wheel, a holder for the spectacle frame, the holder being rotationally coupled to the spectacle-lens retaining shaft and being fixed relative to the spectacle-lens retaining shaft, a feeler head which is largely rigidly connected to a bearing arrangement for the grinding wheel, is fixed relative to the grinding wheel, can be brought into engagement in the facet groove and is intended for measuring the facet groove with regard to its radius and, if need be, its axial value, and/or at least one measuring shoe which is arranged in an axially offset manner next to the grinding wheel, is fixed relative to the grinding wheel, interacts in a contacting manner with a peripheral-contour-ground spectacle lens and is intended for measuring a form wheel or the contour of the spectacle lens with regard to its radius value and, if need be, the axial value of a top facet on the spectacle lens, a position encoder for recording the radius values of the facet groove of the spectacle frame or the spectacle lens or the form wheel at the bearing arrangement for the grinding wheel or the spectacle-lens retaining shaft, an angle encoder for recording the angles of rotation of the spectacle-lens retaining shaft, if need be a position encoder for recording the axial values of the facet groove or the top facet, a computer for storing the measured values and for controlling the spectacle-lens edging machine, in which arrangement the drives for the radial and axial adjustment of the spectacle-lens retaining shaft relative to the grinding wheel and for the rotation of the spectacle-lens retaining shaft consist of stepping motors which at the same time perform the function of position encoders and angle encoders. However, position encoders and angle encoders which are independent of the drives for the radial and axial adjustment of the spectacle-lens retaining shaft relative to the grinding wheel and for the rotation of the spectacle-lens retaining shaft may also be provided.

The spectacle-lens edging machines described in these publications may be provided with a compound-slide guide for the grinding wheels with their drive; however, spectacle-lens edging machines in which the grinding wheels only rotate, but are otherwise fixed, whereas the spectacle-lens retaining shafts are mounted so as to be radially and axially movable relative to the grinding wheels, can also be used.

The spectacle-lens edging machines of the same applicant which are provided with the additional functions described above have proved successful; however, they require additional mechanical attachments and a relatively large control input and are therefore worth improving in this respect.

Described in EP 0 820 837 A1 is a spectacle-lens edging machine which has a set of grinding wheels arranged on a shaft and a crude-lens retaining device. The crude lens can be brought into contact with the grinding wheels by means of the crude-lens retaining device. Furthermore, the machine comprises an additional grinding wheel, which is arranged so as to be freely rotatable on a carrier. The carrier is arranged on a housing part of the spectacle-lens edging machine so as to be pivotable about an axis parallel to the grinding-wheel shaft and can be actuated in such a way that the additional grinding wheel moves between a swung-out rest position and a swung-in working position, in which the axis of rotation of the additional grinding wheel runs parallel to the axis of the shaft and in which the additional grinding wheel is in drive contact with the drive pulley which is arranged on the grinding-wheel set. A drilling tool can be attached to the shaft for the additional grinding wheel, so that it is possible with this arrangement to bevel the form-ground spectacle lens and to provide it with a peripheral channel or with bores. This known arrangement can only be used on spectacle-lens edging machines in which the relative movement between the spectacle lens to be machined and the grinding-wheel stack is effected by appropriate control of the holder for the crude lens. Use on a spectacle-lens edging machine having a compound-slide guide for the grinding-wheel stack is not possible. Furthermore, this known arrangement requires complicated adaptation of the housing of the spectacle-lens grinding machine and a corresponding configuration of the pivot drive for the additional grinding wheel.

SUMMARY OF THE INVENTION

Accordingly, the invention is based on the problem of providing a spectacle-lens edging machine of the type mentioned at the outset with additional functions which can be integrated in the spectacle-lens edging machine in a simple manner and can be controlled by means of the control of the spectacle-lens edging machine.

Starting from this problem, it is proposed in the case of a spectacle-lens edging machine of the type mentioned at the outset that it have, according to the invention, at least one function carrier which is arranged in a coaxially rotatable manner on a bearing neck for a shaft of the grinding wheel or on at least one pivoted lever arranged in an offset position on a bearing neck for a shaft of the grinding wheel and can be swung into the region between the grinding wheel and the spectacle-glass retaining shaft.

The invention is based on the idea that additional movements of the spectacle lens in order to perform certain additional functions are to be avoided in order to restrict the requisite displacements of the spectacle lens to the degree required for the form-machining, and that it is simpler in terms of control and mechanically to swing a function carrier into the region in which the spectacle lens is located anyway for the form-machining.

In the first alternative, the function carrier can be arranged on a splash guard which is present anyway and closely surrounds the grinding wheel with the exception of the grinding region.

In the second alternative, it is possible to provide two appropriately arranged pivoted levers pivotable in opposite directions.

Since the function carrier is arranged approximately centrally relative to the grinding wheel, preferably in the plane of a facet groove of a facet-grinding wheel, the axial movements of the spectacle lens over the grinding wheel can be restricted to the displacement required for the form-machining, which displacement need not be greater than the width of the grinding wheel or of a grinding-wheel stack consisting of rough-grinding and finish-grinding wheels.

With regard to the radial distance of the spectacle-lens retaining shaft with respect to the grinding wheel, the restrictions in the displacement are less important, in particular if the spectacle-lens edging machine is one with a column guide on which a machine upper part with a spectacle-lens retaining shaft is arranged so as to be movable up and down and pivotable at an angle.

A function carrier on the splash guard or on a pivoted lever may have a swing-in U-shaped region having radially projecting legs, the legs serving as stops when measuring and storing the front and rear space curves and, if need be, the thickness of a spectacle lens, clamped in place in the spectacle-lens retaining shaft, in accordance with the radial contour profile in a plane essentially perpendicular to the optical axis. Furthermore, this U-shaped region may also be used to measure and store the radius values of the spectacle lens if the web connecting the legs serves as a support during the contacting measurement.

In order to be able to measure the front and rear space curves without angular errors, probe tips facing one another may be arranged on the insides of the legs, and these probe tips contact the front and rear sides of the spectacle lens only in a point-by-point manner. The U-shaped region may serve as a function carrier for a further function by grinding tools which face away from one another being arranged on the outsides of the legs. These grinding tools serve to bevel the front and rear edges of a spectacle lens. This is required in particular in the case of spectacle lenses made of plastic, the edges of which turn out to be extremely sharp during the form machining.

Furthermore, the function carrier may have a swing-in tool for making channels on the periphery of the form-machined spectacle lens. This tool may be configured as a fixed form-turning tool or as a milling or grinding tool of small diameter rotating at high speed, as described in DE 43 08 800 C2 of the same applicant. Furthermore, the function carrier may have a swing-in tool for making bores or grooves on the spectacle lens for fastening to spectacle frame parts. A further possibility for an additional function is provided by a swing-in inscription device for inscribing the spectacle lens.

The function carriers may be at an angular distance from one another with respect to the pivot axis. In this case, the function carriers move into the region between the grinding wheel and the spectacle-lens retaining shaft in different angular positions.

In another embodiment, the function carriers can be at a radial distance from one another with respect to the pivot axis, so that they can be brought into effect by varying the radial distance of the spectacle-lens retaining shaft from the grinding wheel. In particular, in this case, the tool for making channels and/or the tool for making bores or grooves and/or the inscription device may be arranged in the region of the web of the U-shaped region, and the probe tips and the grinding tools may be arranged at a radial distance therefrom at the ends of the legs.

In a spectacle-lens edging machine having a grinding wheel which is arranged with its drive on a machine lower part carrying a guide column and which has a facet groove, and having a spectacle-lens retaining shaft which is arranged with its drive on a machine upper part and is thus rectilinearly movable up and down and is pivotable about an axis of the guide column, this axis being at a distance from and perpendicular to the axes of the grinding wheel and the spectacle-lens retaining shaft, the probe tips may each be at the same axial distances apart on both sides of the facet groove, and the tool for making channels may be arranged radially in the plane of the facet groove. Since the axes of the grinding-wheel shaft and of the spectacle-lens retaining shaft run essentially parallel to one another in such a spectacle-lens edging machine, angular errors when measuring the front and rear space curves and when making channels are smallest if a spectacle lens held in the spectacle-lens retaining shaft is oriented centrally relative to the facet groove. If need be, these angular errors can be taken into account by computation by means of the CNC control of such a spectacle-lens edging machine.

If the position and angle encoders which are present anyway for a vertical-adjustment drive and for a pivot drive for the machine upper part of such a spectacle-lens edging machine are also used for measuring the front and rear space curves and the radius values of the spectacle lens, an especially simple construction and a simple control of the above-mentioned spectacle-lens edging machine with CNC control are achieved.

BRIEF DESCRIPTION OF THE DRAWINGS

The invention is described in more detail below with reference to several exemplary embodiments shown in the drawing, in which.

DESCRIPTION OF A PREFERRED EMBODIMENTS

Figure 1:
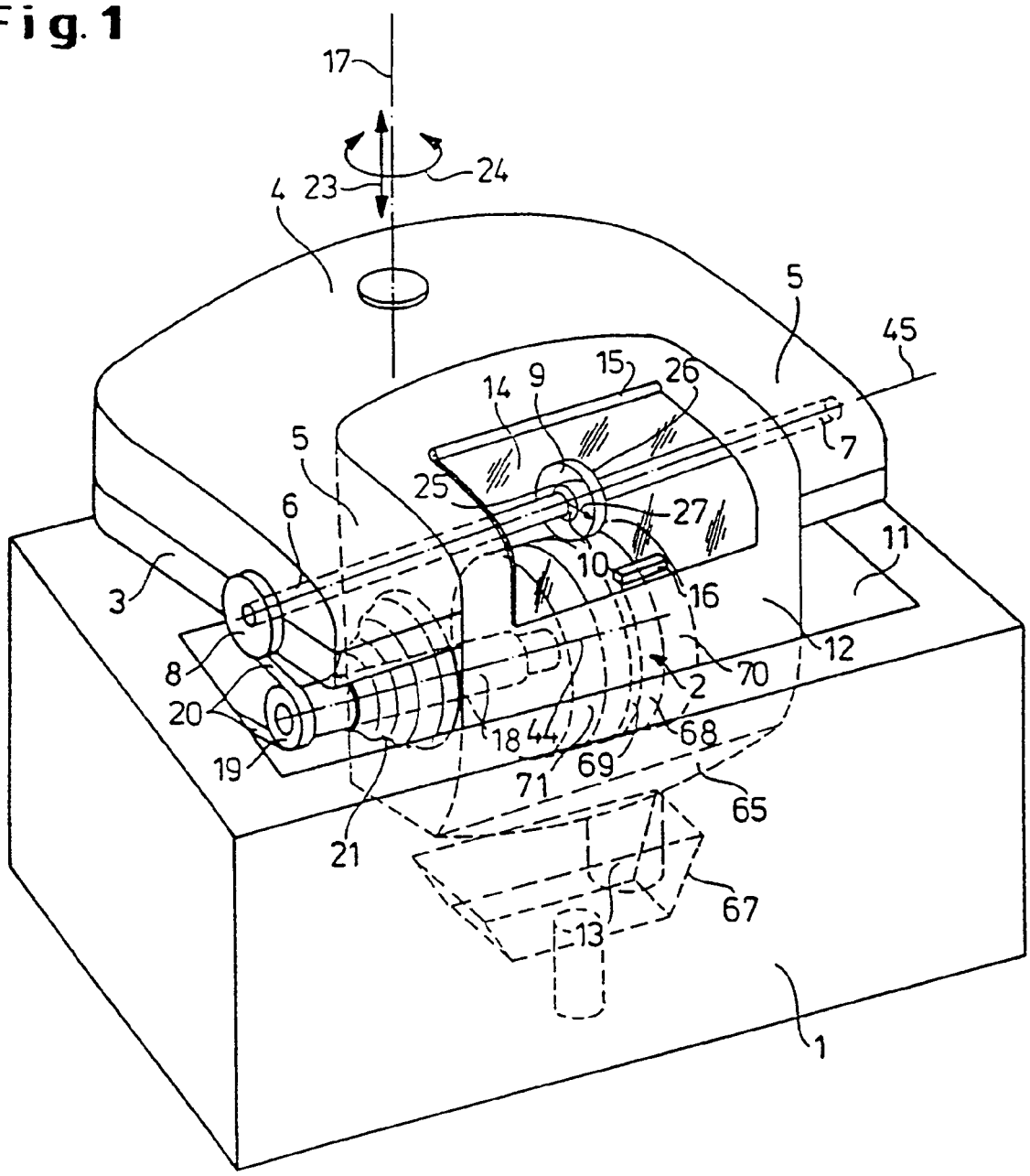
FIG. 1 shows a perspective view of a spectacle-lens edging machine with the swing-in function carriers according to the invention.

Shown in a schematic, perspective view in FIG. 1 is a spectacle-lens edging machine, of which a machine lower part 1 is depicted, in which the entire mechanical and electrical system for carrying out the grinding operation and for controlling the same are arranged. A grinding-wheel stack 2 consisting of a center fine-grinding wheel 68 with a facet groove 69 and rough-grinding wheels 70, 71 arranged on both sides, of which one is intended for the rough grinding of silicate lenses and the other is intended for the rough grinding of plastic lenses, is mounted with its grinding spindle 18 in the machine lower part 1 and is set in rapid rotation by an electric motor (not shown) via a drive belt 20 and a belt pulley 19. The facet groove 69 of the fine-grinding wheel 68 is in alignment with a guide column 17 (only shown by its axis) for a machine upper part 3 in such a way that an axis 45 of a spectacle-lens retaining shaft 6, 7 lies in a center position essentially parallel to an axis 44 of the grinding-wheel stack 2 during the grinding of a top facet of a spectacle lens 9. The machine upper part 3 is mounted so as to be pivotable about the perpendicular axis of the guide column 17 and so as to be movable up and down. A housing 4 of the machine upper part 3 covers the same and its lateral arms 5. A half shaft 6 and a half shaft 7 are coaxially mounted in the lateral arms 5 and can be set in slow rotation by means of a drive (not shown). The half shafts 6, 7 serve to clamp a spectacle-lens blank 9 in place by means of a block or sucker 10, as a result of which the spectacle-lens blank 9 is prepared for carrying out the peripheral form grinding. The half shafts 6, 7 therefore form the spectacle-lens retaining shaft for the spectacle-lens blank 9.

In order to clamp the spectacle-lens blank 9 in place, one half shaft 6 is axially displaced, e.g. by means of an actuating button 8. Likewise, it is possible to provide a controllable drive for the axial displacement of the half shaft 6.

Arranged between the arms 5 of the machine upper part 3 is a grinding chamber 12 which encloses the region of the half shafts 6, 7 between the arms 5 and the grinding-wheel stack 2. The grinding chamber is essentially of parallelepiped configuration having sealed leadthroughs for the half shafts 6, 7 and the grinding spindle 18 and having a hinged lid 14. The grinding chamber 12 and a cooling-liquid outflow 13 arranged on the bottom part of the grinding chamber 12 project for the most part into a recess 11 of the machine lower part 1, the cooling-liquid outflow 13 being directed into a collecting trough 67 of funnel-like design in the machine lower part 1, from where the cooling liquid flows off into a collecting tank (not shown) for further processing.

A bellows 21 is arranged between the grinding spindle 18 and a side wall of the grinding chamber 12 through which the grinding spindle 18 is directed, and this bellows 12 is tightly connected to the side wall of the grinding chamber 12 and the grinding spindle 18 but gives the grinding chamber 12 sufficient clearance of motion relative to the grinding spindle 18 in the direction of arrows 23, 24 in the region of the pivot axis of the guide column 17.

The grinding chamber 12 is closed by means of the transparent hinged lid 14, which is linked to the top wall of the grinding chamber 12 by means of a hinge 15 and can be swung up into the open position by acting on a handle 16.

The details of the drives for the controlled vertical adjustment and pivoting movement about the axis of the guide column 17 and of the position and angle encoders required for this are described in WO 98/09770 A1 of the same applicant, to which reference is expressly made.

The perpendicular up and down movement in the direction of arrow 23 is effected by a CNC control (not shown), as a result of which the machine upper part 3, and thus the spectacle-lens retaining shaft 6, 7 with a spectacle lens 9 clamped in place, performs a movement corresponding to the spectacle-lens contour to be ground.

The pivoting, which is likewise CNC-controlled, about the perpendicular axis of the guide column 17 according to arrow 24 allows the spectacle-lens blank 9 to move in a reciprocating manner across the width of the grinding wheel 70 or 71. This uniform reciprocating movement, on the one hand, serves to achieve uniform wear of the cylindrical rough-grinding wheels 70, 71. On the other hand, this controlled movement can be used to shift the spectacle-lens blank 9 into the facet groove 69 of the fine-grinding wheel 68 after the rough grinding has been completed and to grind a top facet onto the form-ground spectacle lens 9.

This facet grinding may be effected as free grinding if the form-ground spectacle lens can plunge over its entire width into the facet groove 69, so that the peripheral contour of the form-ground spectacle lens determines the profile of the top facet.

It is likewise possible when grinding the top facet to control the pivoting movement about the axis of the guide column 17 by means of the pivot drive (not shown), so that the top facet is given a predetermined profile on the periphery of the rough-ground spectacle lens.

During the grinding, cooling liquid is sprayed by means of nozzles (not shown) into the region between the spectacle-lens blank 9 and the grinding-wheel surface, the cooling liquid also serving to draw off the abrasive grit. A further cooling-liquid circuit (not shown) is arranged on the rear wall of the grinding chamber 12 and provides for wetting over the surface of the rear wall at least in accordance with the width of the grinding-wheel stack 2 like a curtain of liquid. In this way, the abrasive grit during the grinding of plastic lenses is flushed off, and lumps which are difficult to remove and disturb the grinding operation cannot form. Since the grinding chamber 12 is closed all round with the exception of the outflow 13, no cooling liquid and no abrasive grit can pass out of the grinding chamber 12 during the grinding operation into the region of the control and the drives in the machine upper and lower parts 3, 1. On the contrary, the cooling liquid is directed via the outflow 13 to a separator (not shown), where the abrasive grit is separated from the cooling liquid. If fresh water is fed as cooling water to the nozzles referred to, the cooling water freed of abrasive grit can be passed directly into the drains. However, it is also possible to circulate the cooling liquid by providing a circulating pump, which draws in the cleaned cooling liquid after the separation and feeds it again to the nozzles. In this case, the addition of additives to the cooling liquid, e.g. corrosion-inhibiting and foam-removing additives, also poses no problems.

Instead of arranging the machine upper part 3, with the spectacle-lens retaining shaft 6, 7 and all the drives and the grinding chamber 12, in such a way that it is liftable, lowerable and pivotable, it is also possible to support the machine upper part 3 on the machine lower part 1 and to arrange the grinding-spindle stack 2 with the grinding spindle 18 and the drive motor 22 on an arm in such a way that it is liftable and lowerable along the guide column 17 and pivotable about the perpendicular axis of the latter. The drives for the lifting and lowering movements and for the pivoting movement may be configured in a similar manner to the corresponding drives for the movable machine upper part 3. The movable leadthrough of the grinding spindle 18 through a side wall 63 of the grinding chamber 12 and its sealing by means of a bellows 21 may likewise be configured in a similar manner. In this arrangement, a movable leadthrough of the outflow 13 through the machine lower part 1 is not necessary, so that simpler sealing is also possible.

If need be, the machine upper part 3 with the housing 4 may be arranged in a hood (not shown), which may also accommodate the CNC control for the spectacle-lens edging machine and may also have a screen and a keyboard on a front wall for the input of data and commands.

This spectacle-lens edging machine is distinguished by a simple column guide for the machine upper part or the grinding wheel with drive, both the column guide and the drives being protected against cooling liquid splashing off the rotating grinding wheel 2 by the grinding chamber 12 enclosing the spectacle-lens retaining shaft 6, 7 and the grinding wheel 2, and the machine not being contaminated by abrasive grit.

The drives for the vertical adjustment and pivoting of the machine upper part 3 can be integrated in the machine in a space-saving and functional manner, as a result of which considerable operating reliability and accuracy during the spectacle-lens edging are ensured, yet the machine is of simple and robust construction and can be manufactured in a cost-effective manner.

Function carriers, which are described below with reference to FIGS. 2 to 8, can be integrated in the spectacle-lens edging machine described above. Such function carriers can serve to measure the front and rear space curves and, if need be, the thickness of the spectacle lens in accordance with the radial contour profile in a plane essentially perpendicular to the optical axis and to store the determined data in order to establish from them, for example, the profile of a top facet on the periphery of the form-ground spectacle lens and, if need be, to carry out a regrind if deviations in the shape of the spectacle lens are measured. Furthermore, such a function carrier can serve to bevel the edges of a form-ground spectacle lens, to make channels on the periphery of a form-ground spectacle lens, or to provide the form-ground spectacle lens with bores or grooves for fastening spectacle frame parts. Inscription of a spectacle lens by means of such a function carrier is also possible.

Figure 4:
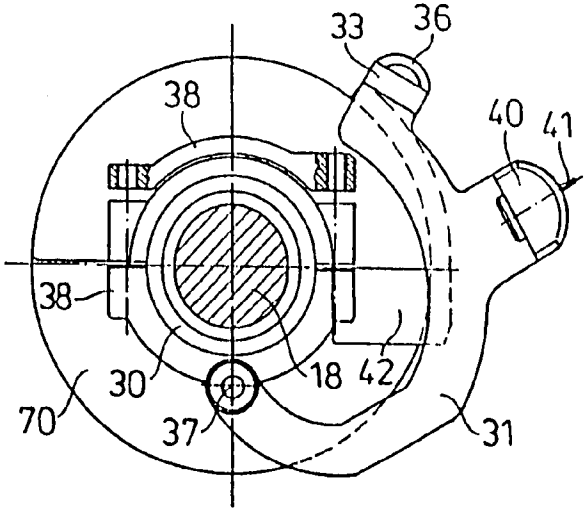
FIGS. 2 to 4 show various views of a second embodiment of function carriers on a pivoted lever.
Figure 3:
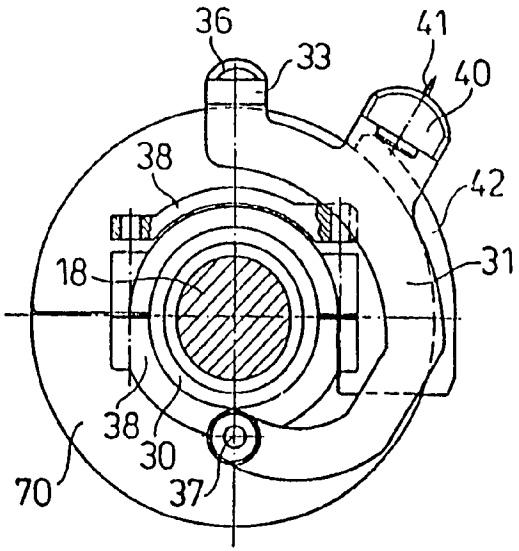
Figure 2:
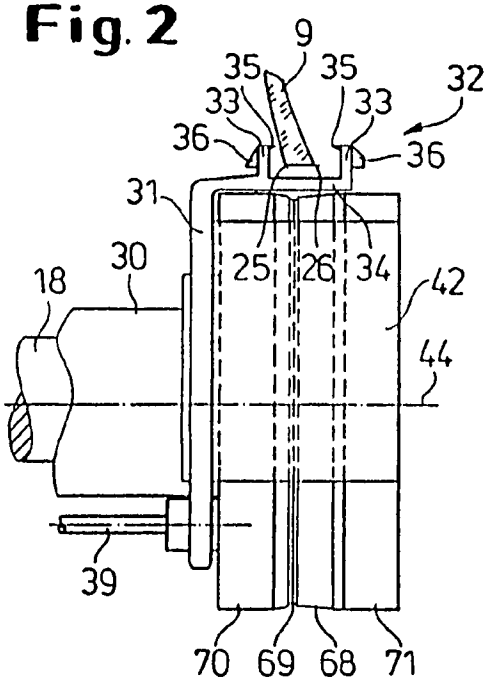

FIGS. 2 to 4 show a first embodiment of function carriers 32, 40, which are arranged at an angular distance with respect to a pivot axis 37 of a pivoted lever 31. The pivot axis 37 of the pivoted lever 31 is arranged on a holder 38 in an offset position with respect to the axis 44 of the grinding-wheel shaft 18. The holder 38 is clamped to a bearing neck 30 for the grinding-wheel shaft 18. A pivot drive (not shown) acts on a shaft 39 fastened to the pivoted lever 31. The function carrier 32 consists of a U-shaped region on the pivoted lever 31 with radially projecting, parallel legs 33 and a web 34 connecting the legs 33. Probe tips 35 located opposite one another are arranged on the insides of the legs 33, whereas beveling tools 36 are fastened to the outsides of the legs 33.

During the form grinding of a spectacle lens 9, the pivoted lever 31 is located in the position shown in FIG. 4, so that the region of the grinding wheels 68, 70, 71 on which contact with the spectacle lens 9 takes place during the grinding is exposed, while the remaining regions of the grinding wheels 68, 70, 71 are covered by a splash guard 42. If the front and rear space curves 25, 26 of the spectacle lens 9 are to be measured, the pivoted lever 31 is pivoted by means of the pivot drive acting on the shaft 39 into the position shown in FIGS. 2 and 3, and the spectacle lens 9 is brought into the position shown in FIG. 2. To measure the front space curve 25, the spectacle lens 9 is brought to bear with light pressure against the left-hand probe tip 35 and rotated by one revolution. In the process, by means of the CNC control already mentioned (but not described in detail), the radial distance between the axis 44 of the grinding-wheel stack 2 and the axis 45 of the spectacle-lens retaining shaft 6, 7 is varied in accordance with the peripheral contour of the spectacle lens, so that the spectacle lens describes, with respect to the left-hand probe tip 35, a path which corresponds to the peripheral contour. The pivoting movement of the machine upper part occurring in the process in accordance with arrow 24 is recorded by the angle encoder referred to (but not shown) and produces, in combination with the values of the peripheral contour, a data record to be stored for the front space curve 25.

To measure the rear space curve 26, the spectacle lens 9 is brought to bear against the right-hand probe tip 35 and the operation is repeated. This scanning of the space curve may be effected both on an already form-ground spectacle lens and on a circular crude lens in the manner described.

The radius values of the spectacle lens 9—also in this case on a circular crude lens or a form-ground spectacle lens—can be determined by the crude lens being placed with its periphery on the web 34 and being rotated by one revolution. The movement of the machine upper part 3 which occurs in the process in accordance with arrow 23 along the axis of the guide column 17 is recorded by means of a displacement sensor (not shown) and produces, in combination with the rotation of the spectacle-lens retaining shaft 6, 7, which is recorded by an angle encoder, a data record for the radius values of the spectacle lens 9, this data record likewise being stored with the CNC control of the spectacle-lens edging machine.

To bevel the edges 25, 26, the spectacle lens 9 is shifted onto the beveling tools 36. These beveling tools preferably consist of diamond grinding elements having a conical surface. To bevel the edge 25, this edge is put onto the conical surface of the right-hand beveling tool 36 and the spectacle lens 9 is set in rotation. A corresponding procedure is used to bevel the edge 26 on the left-hand beveling tool 36.

Figure 6:
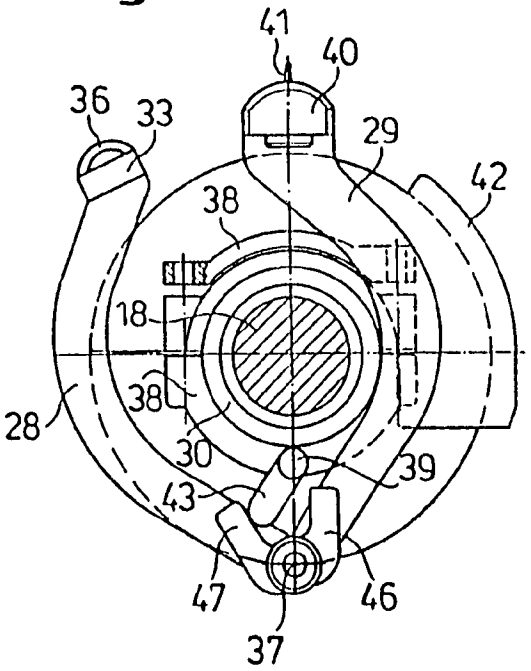

If the periphery of a form-ground spectacle lens 9 is to be provided with a peripheral groove instead of a top facet, the pivoted lever 31 is pivoted further, so that a high-speed drive motor 40 having a milling or grinding tool 41 of small diameter is brought into a position which corresponds to the position shown in FIG. 6. In this position, the spectacle lens 9 can be brought into the region of the milling or grinding tool 41 in a CNC-controlled manner and a groove can be made in the outer periphery of the spectacle lens 9.

Instead of arranging the U-shaped region 32 and the drive motor 40 having the milling or grinding tool 41 at an angular distance on the pivoted lever 31 as shown in FIGS. 2 to 4, it is also possible to fasten the drive motor 40 between the legs 33 on the web 34. In this case, the legs 33 must be lengthened to such an extent that, on the one hand, the front and rear space curves 25, 26 of the spectacle lens 9 can be measured without getting into the region of the milling or grinding tool 41, whereas, on the other hand, it becomes possible to make a peripheral groove by bringing the spectacle lens 9 closer to the milling or grinding tool 41.

Figure 7:
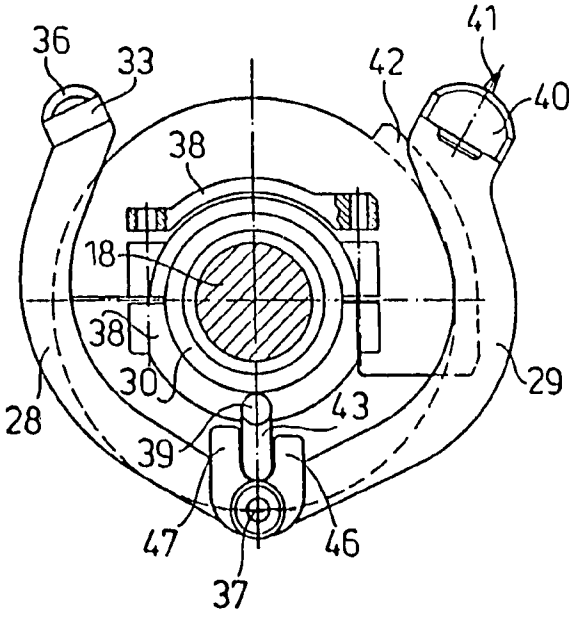
FIGS. 5 to 7 show various views of a first embodiment of function carriers on two pivoted levers.
Figure 5:
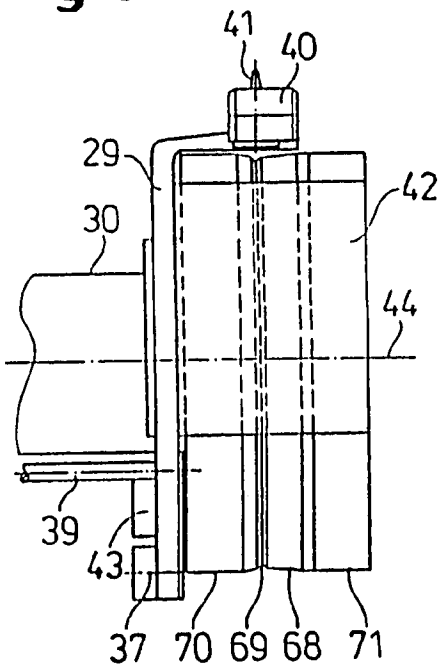

In the embodiment shown in FIGS. 5 to 7, pivoted levers 28, 29 which are movable in opposite directions are arranged so as to be pivotable about the pivot axis 37. These pivoted levers 28, 29 are fastened to the bearing neck 30 in an analogous manner by means of the holder 38. Mounted on this holder 38 is the shaft 39 which has an actuating lever 43, which interacts with an actuating extension 46 on the pivoted lever 28 and with an actuating extension 47 on the pivoted lever 29. By rotation of the shaft 39, the actuating lever 43 can be pivoted and the pivoted levers 28, 29 can alternately be brought into a position in which the function carrier 32, i.e. the U-shaped region on the pivoted lever 28, or the function carrier 40, i.e. the drive motor 40 having the milling or grinding tool 41 on the pivoted lever 29, can be brought into the region of the spectacle lens 9 on the spectacle-lens retaining shaft 6, 7. In FIGS. 5 and 6, the drive motor 40 having the milling or grinding tool 41 is pivoted into the region of the spectacle lens, whereas the pivoted lever 28 is swung out of this region. In FIG. 7, the pivoted levers 28, 29 are shown in the swung-out position, in which the function carriers 32, 40 are located outside the region of the spectacle lens 9 clamped in place in the spectacle-lens retaining shaft 6, 7.

Since the machine upper part 3 with the spectacle lens 9 performs a pivoting movement in accordance with arrow 24 both during the measuring of the front and rear space curves 25, 26 and when a peripheral groove is being made by means of the milling or grinding tool 41, it is important that, in the case of the function carrier 32, the probe tips 35 are at the same distance apart on both sides of the facet groove 69 and that the milling or grinding tool 41, as shown in FIG. 5, is located in the plane of the facet groove 69.

In order to obtain the requisite low applied pressure against the beveling tools 36 during the beveling and against the probe tips 35 during the measuring of the front and rear space curves 25, 26 and to avoid scratching of the spectacle-lens surfaces, the pivot drive for the machine upper part 3 may have a magnetic coupling, the transmittable torque of which can be adapted to the respective operating cycle or measuring operation in the sense that the transmittable torque is high during the controlled grinding of a facet and is low during the measuring of the front and rear space curves 25, 26 and during the beveling.

Figure 8:
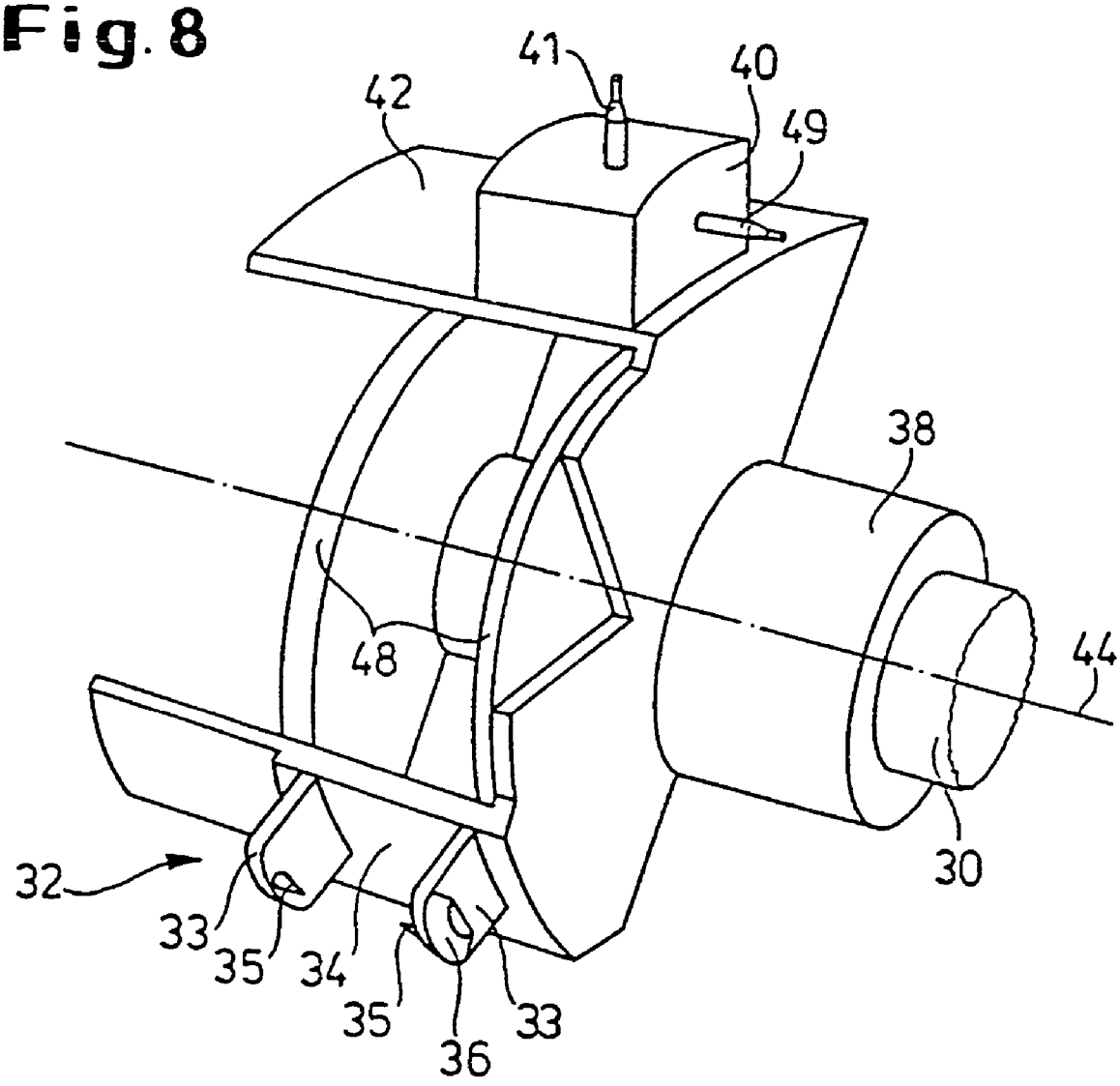
FIG. 8 shows a perspective view of a further embodiment of function carriers on a splash guard.

In the exemplary embodiment described in FIG. 8, the splash guard 42 is pivotably mounted on the bearing neck 30 by means of the holder 38 and has, on one side, a U-shaped region 32 as first function carrier having radially projecting webs 33, which are connected via web region 34 and carry the probe tips 25 and the beveling tool 36, and also, on the other side, a function carrier which is designed as drive motor 40 and is at an angular distance from the function carrier 32. Arranged on this drive motor 40 is a radial milling or grinding tool 41, which, as already described with respect to FIGS. 2 to 7, serves to make a groove on the periphery of a spectacle lens 9, whereas a further milling or grinding tool 49 is additionally arranged parallel to the axis 44 of the grinding-wheel shaft and serves to make bores or grooves on a spectacle lens. Such bores or grooves serve to fasten spectacle frame parts, such as sides and a bridge.

A spectacle lens held by the spectacle-lens retaining shaft 6, 7 can be brought into the region of the milling or grinding tool 49 with accuracy of position in a CNC-controlled manner in order to then be machined in the manner described.

In order to bring the function carriers 32, 40 into the region of the spectacle lens 9 held by the spectacle-lens retaining shaft 6, 7, the splash guard 43 is rotated about the axis 44 by means of a drive (not shown). The splash guard 42 is connected to the holder 38 via ring segments 48, between which the grinding wheels 68, 70, 71 are arranged. In this embodiment, too, it is possible to arrange the function carriers 32, 40 on the splash guard 42 so as to be radially offset instead of being offset at an angle.

The invention claimed is:

1. A spectacle-lens edging machine comprising:

at least one grinding wheel on a shaft, and having a bearing neck for the shaft;

a rotatable spectacle-lens retaining shaft radially and axially adjustable relative to the grinding wheel and the grinding wheel shaft;

at least one function carrier arranged in a coaxially rotatable manner on the bearing neck for the grinding wheel shaft or on at least one pivoted lever arranged in an offset position on the bearing neck for the grinding wheel shaft, wherein the function carrier can be swung into a region between the grinding wheel and the spectacle lens retaining shaft; wherein:

the function carrier includes a swing-in U-shaped region having radially projecting legs which serve as stops during measuring and storing of one or more of front and rear space curves, and a thickness of a spectacle lens, the legs is clamped in place in the spectacle-lens retaining shaft, in accordance with a radial contour profile of the lens in a plane essentially perpendicular to the optical axis.

2. The spectacle-lens edging machine as claimed in claim 1, wherein the function carrier has projecting legs at opposite sides of the lens; a web connecting the legs, the web serving as a support during contacting measurement and storage of radius values of the spectacle lens.

3. The spectacle-lens machine as claimed in claim 2, wherein the legs have insides and further comprising probe tips facing one another and arranged on the insides of the legs.

4. The spectacle-lens edging machine as claimed in claim 2, wherein the legs have outsides, and further comprising grinding tools facing away from one another and arranged on the outsides of the legs and intended for beveling the front and rear edges of a spectacle lens.

5. A spectacle-lens edging machine as claimed in claim 1, wherein:

the function carrier has projecting legs at opposite sides of the lens and a web connecting the legs;

the web serves as a support during contacting measurement and storage of radius values of the spectacle lens;

the legs have insides with probe tips facing one another arranged on the insides of the legs;

the grinding wheel has a first drive;

the grinding and the first drive are arranged on a lower part of the machine;

the lower part of the machine carries a guide column;

the grinding wheel includes a facet groove;

the spectacle-lens retaining shaft has a second drive;

the spectacle lens retaining shaft and the second drive are arranged on an upper part of the machine;

the retaining shaft is rectilinearly movable up and down and is pivotable about an axis of the guide column;

the guide column axis is spaced at a distance from and perpendicular to the axes of the grinding wheel and of the spectacle-lens retaining shaft;

the probe tips are each at the same axial distances apart on both sides of a facet groove in the grinder wheel; and a tool for making channels is arranged radially in the plane of the facet groove.

6. The spectacle-lens edging machine as claimed in claim 5, further comprising:

a vertical-adjustment drive for up and down motion and a pivot drive for rotary motion of the machine upper part, and position and angle encoders for the machine upper part, wherein the position and angle encoders also measure front and rear space curves and radius values of the spectacle lens.

7. A spectacle-lens edging machine comprising:

at least one grinding wheel on a shaft, and having a bearing neck for the shaft;

a rotatable spectacle-lens retaining shaft radially and axially adjustable relative to the grinding wheel and the grinding wheel shaft;

two function carriers arranged in a coaxially rotatable manner on the bearing neck for the grinding wheel shaft or on two pivoted levers arranged in offset positions on the bearing neck for the grinding wheel shaft and pivotable in opposite directions, and wherein the function carrier can be swung into a region between the grinding wheel and the spectacle lens retaining shaft;

the two function carriers are at a radial distance from one another with respect to the pivot axis of the function carriers and the pivot axis of the grinding wheel;

the function carriers have projecting legs at opposite sides of the lens and webs connecting the legs, the webs serving as supports during the contacting measurement and storage of radius values of the spectacle lens;

a tool for making channels, a tool for making bores or grooves, and an inscription device are arranged in U-shaped regions of the webs; and the probe tips and the grinding tools are arranged at radial distances from respective U-shaped regions of the webs at the ends of the legs.

8. A spectacle-lens edging machine comprising:

a rotatable spectacle-lens retaining shaft;

a grinding wheel shaft, radially and axially adjustable relative to the spectacle lens retaining shaft;

at least one grinding wheel on the grinding wheel shaft, and a bearing neck for the grinding wheel shaft;

a drive mechanism for rotating the grinding wheel shaft;

a function carrier movably supported on the bearing neck for the grinding wheel shaft whereby the function carrier can be swung into a region between the grinding wheel and the spectacle-lens retaining shaft;

a swing-in rotatable tool on the function carrier operable to form a cut in the spectacle-lens;

the rotatable tool in its operative position having its rotational axis parallel to the rotational axis of the spectacle-lens retaining shaft and of the grinding wheel shaft and a dedicated drive motor for the rotatable tool mounted on the function carrier, wherein the drive motor rotates at a high speed compared to that of the grinding wheel shaft.

9. A spectacle-lens edging machine as claimed in claim 8, wherein the function carrier is mounted in a coaxially rotatable manner on the bearing neck for the grinding wheel shaft.

10. A spectacle-lens edging machine as claimed in claim 9, wherein the function carrier is mounted on a splash guard for the grinding wheel.

11. A spectacle-lens edging machine as claimed in claim 10, further including a second function carrier mounted on the splash guard for the grinding wheel.

12. A spectacle-lens edging machine as claimed in claim 9, further including a second function carrier mounted in a coaxially rotatable manner on the bearing neck for the grinding wheel shaft.

13. A spectacle-lens edging machine as claimed in claim 8, wherein:

the function carrier is located on a lever pivotally mounted on the bearing neck for the grinding wheel shaft;

the lever has a pivot axis radially offset from the rotational axis for the grinding wheel shaft; and the lever is configured and positioned so the function carrier can be swung into a region between the grinding wheel and the spectacle-lens retaining shaft.

14. A spectacle-lens edging machine as claimed in claim 13, further including a second function carrier located on the pivotally mounted lever, and positioned so that it can be swung into the region between the grinding wheel and the spectacle-lens retaining shaft.

15. A spectacle-lens edging machine as claimed in claim 13, further including a second function carrier located on a second lever pivotally mounted on the bearing neck for the grinding wheel shaft, wherein:

the second lever has a pivot axis radially offset from the rotational axis for the grinding wheel shaft; and the second lever is configured and positioned so the second function carrier can be swung into the region between the grinding wheel and the spectacle-lens retaining shaft.

16. A spectacle-lens edging machine as claimed in claim 15, wherein the first and second levers are pivotally mounted on a common pivot axis.

17. A spectacle-lens edging machine as claimed in claim 16, further including an actuating mechanism which cooperates with the first and second levers to alternately swing the first recited function carrier or the second function carrier into the region between the grinding wheel and the spectacle-lens retaining shaft.

18. A spectacle-lens edging machine as claimed in claim 8, wherein the swing-in rotatable tool is operable to form bores in the spectacle-lens for fastening the lens to spectacle frame parts.

19. A spectacle-lens edging machine as claimed in claim 8, wherein the swing-in rotatable tool is operable to form grooves in the spectacle-lens for fastening the lens to spectacle frame parts.

20. A spectacle-lens edging machine as claimed in claim 8, wherein the swing-in rotatable tool is operable to form a bevel on the edge of the spectacle-lens.

* * * * *